US006988336B2

(12) United States Patent
Rupp

(10) Patent No.: US 6,988,336 B2
(45) Date of Patent: Jan. 24, 2006

(54) FIREPLACE ENCLOSURE

(75) Inventor: Michael D. Rupp, Holland, NY (US)

(73) Assignee: Countryside Stove & Chimney Inc., Holland, NY (US)

( * ) Notice: Subject to any disclaimer, the term of this patent is extended or adjusted under 35 U.S.C. 154(b) by 0 days.

(21) Appl. No.: 10/452,368

(22) Filed: Jun. 2, 2003

(65) Prior Publication Data

US 2004/0237417 A1 Dec. 2, 2004

(51) Int. Cl.
*E04B 1/00* (2006.01)

(52) U.S. Cl. ..... 52/79.1; 52/36.3; 52/218; 52/219; 126/9 A; 126/9 B; 126/9 R; 126/275 R

(58) Field of Classification Search ..... 52/36.1, 52/36.3, 79.1, 270, 218, 219; 126/500, 520, 126/553, 9 R, 9 B, 11, 19 R, 275 R, 222, 126/225, 283, 9 A; 237/1 R; 110/336, 337, 110/317

See application file for complete search history.

(56) References Cited

U.S. PATENT DOCUMENTS 3,562,972 A * 2/1971 D'amato ..... 52/66
3,926,174 A * 12/1975 Bell ..... 126/516
3,990,197 A * 11/1976 Johnston ..... 52/125.2
4,470,399 A * 9/1984 Pitha ..... 126/523
4,553,276 A * 11/1985 Paradis ..... 4/612
5,036,634 A * 8/1991 Lessard et al. ..... 52/79.1
5,249,567 A * 10/1993 Maitland et al. ..... 126/519
5,299,558 A * 4/1994 Binzer ..... 126/512
5,426,900 A * 6/1995 Springer ..... 52/79.1
5,485,830 A * 1/1996 Binzer ..... 126/512
5,647,342 A * 7/1997 Jamieson et al. ..... 126/512
5,794,610 A * 8/1998 Facchina ..... 126/512
6,024,085 A * 2/2000 Hodge et al. ..... 126/500
6,029,655 A * 2/2000 Hussong et al. ..... 126/515
6,109,257 A * 8/2000 Hodge et al. ..... 126/500

* cited by examiner

*Primary Examiner*—Jeanette E Chapman
(74) *Attorney, Agent, or Firm*—Phillips Lytle LLP

(57) ABSTRACT

A prefabricated fireplace enclosure (10) configured and arranged for compact packaging which comprises first and second side panels (20, 21), first and second mounting members (40, 44) securable to the exterior wall of a building, a rear panel (22, 23) and a bottom panel (24) adapted for positioning between the first and second side panels, and a roof assembly (25) adapted for support by the first and second side panels, wherein each of the panels, mounting members and roof assembly are configured and arranged so as to allow for compact packaging and shipment to the construction site in a disassembled condition.

12 Claims, 7 Drawing Sheets

FIREPLACE ENCLOSURE

TECHNICAL FIELD

This invention relates generally to fireplaces, and, more specifically, to prefabricated fireplace enclosures.

BACKGROUND OF INVENTION

In recent years, as many as sixty percent of new homes have been built with at least one fireplace. Many new buildings incorporate one or more fireplaces as well. The advent of "direct vent" fireplaces has allowed for relatively inexpensive installation of new fireplaces in new and existing homes and structures. Traditional masonry work, on the other hand, has become prohibitively expensive and time consuming for many.

Fireplace enclosures which surround fireplaces are typically built by contractors on site with the same materials which form the exterior of the home or building, e.g. wood, composites and siding. Therefore, in addition to building a wood or composite frame, insulation, refractory lining and/or masonry work may be required before a fireplace may be installed in a fireplace enclosure. Such additional work must be performed at the construction site, with associated labor costs, and often takes days to complete.

It is estimated that more than seventy-five percent of all fireplaces installed today are factory-built and shipped to the construction site. Most fireplaces shipped are direct vent fireplaces which vent directly outside, so there is no need for a traditional chimney or masonry. In addition, they may be installed inexpensively, without the use of skilled craftsmen. "Rear vent, direct vent" fireplaces vent from the rear of the fireplace, collecting combustible air from outside and pumping the by-products of burning gases outside. "Top vent, direct vent" fireplaces vent from the top of the fireplace using the same principles. Approximately eighty percent of new direct vent fireplaces are rear vent, while twenty percent are top vent. A "B-vent" system is a top vented system that uses room air for combustion. Some direct vent systems operate more efficiently when the vent termination is above the roof line of the associated home or building.

Fireplace enclosures which project outward from an associated living or office space, for example, require some method of support. This is typically accomplished by unattractive bracing or reinforcement, expensive masonry or concrete work, or the extension of a support member into the associated living or office space, (e.g., a support member extending four feet inside to support a two-foot deep enclosure). In addition, existing fireplace enclosures often require rerouting of mechanical, electrical and/or plumbing features.

Prior art discloses prefabricated framed fireplaces (e.g., U.S. Pat. No. 6,374,822 (Lyons, et al.)) which provide a fireplace box with an attached surrounding framework of building materials which becomes a permanent part of the wall or structure to which it is attached. The prior art, however, does not provide a fireplace enclosure adapted for compact packaging or shipping in knock-down condition. Nor does it disclose a modular fireplace enclosure which is adjustable and flexible in terms of height. For example, some top vent, direct vent systems, either for cosmetic purposes or for efficiency, require a fireplace enclosure or flue which extends upward along a substantial portion of the exterior wall of the house or building in which the fireplace is installed. The present invention solves this problem by providing stackable, essentially modular side and rear panels, whereas the prior art discloses a one-piece construction of parts integrally molded together.

In addition, the prior art requires a rough opening of substantially the same size as the fireplace box, whereas the present invention, because it is secured to the exterior wall of the structure, from the outside, has no such limitation. In addition, the prior art, because it includes brackets and/or flanges which connect to the interior of the associated structure, must be installed, at least in part, from the interior of the structure. The prior art limits access from the exterior, resulting in difficulty or inconvenience in installing associated gas and/or electric lines. Among other things, the present invention diminishes or eliminates such inconvenience and diminishes or eliminates the need to reroute such items as electrical and plumbing lines and mechanical members.

There exists a need for a simple, self-supported fireplace enclosure which is prefabricated and capable of being shipped in knock-down or disassembled condition by standard methods such as UPS, FedEx and U.S. Mail; which may be assembled quickly and efficiently at the construction site without the need for skilled contractors or additional materials such as insulation, Sheetrock or bracing members; which may be assembled from the exterior of the associated structure; which may be used in conjunction with a wide variety of fireplaces available to the public; which provides for variable height by stacking to accommodate various styles of fireplaces and configurations; and/or which allows efficient access from the exterior of the associated home or building to electric and gas lines.

DISCLOSURE OF THE INVENTION

With parenthetical reference to the corresponding elements or portions of the disclosed embodiment, merely for purposes of illustration and not by way of limitation, the present invention provides an improved fireplace enclosure, which is prefabricated and configured and arranged for simple and compact packaging and delivery to the construction site. The fireplace enclosure may be installed at the construction site quickly and efficiently, without the need for additional bracing, Sheetrock or insulation, and without the need for skilled craftsmen or experienced contractors. If the home or building to which the fireplace enclosure will be attached has a rough opening to accept a fireplace, the improved fireplace enclosure may be installed in minutes with only a drill and machine screws. Because the fireplace enclosure may be installed piece by piece from the outside of the associated structure, the installer is provided with easy access to gas and electric lines.

One aspect of the invention provides a prefabricated fireplace enclosure (10) adapted for compact packaging and connection to an exterior supporting wall of a structure, having a first side panel (20) and a second side panel (21); first (40) and second (44) mounting members securable to the supporting wall for supporting the first and second side panels, respectively; a rear panel (22, 23) and a bottom panel (24) adapted for positioning between the first and second side panels; a roof assembly (25) adapted for support by the first and second side panels; wherein each of the panels, mounting members and roof assembly are configured and arranged so as to allow for compact packaging and shipment to the construction site in a disassembled condition. In this aspect of the invention, the resulting fireplace enclosure assembled from the foregoing components forms a part of the exterior of the structure to which it is connected.

In another aspect of the invention, the fireplace enclosure includes two upper side panels (27, 29), two upper mounting members (30, 31) securable to the supporting wall for supporting the upper side panels, and an upper rear panel (28) positioned between the two upper side panels, wherein the upper side panels and upper rear panels are configured so as to be vertically stacked upon the corresponding side panels and rear panels beneath them (20, 21, 22). This aspect of the invention provides for adjustment of the height of the fireplace enclosure. In other words, consecutive side and rear panels may be stacked upon each other, for decorative or efficiency purposes, as high as the roof line of the associated home or building.

In another aspect of the invention, the upper rear panel has two vertical edge portions (28A, 28B), a first lateral channel (28C) extending parallel to a first vertical edge portion (28A), and a second lateral channel (28D) extending parallel to a second vertical edge portion (28B), wherein the first lateral channel is adapted to receive the first upper side panel, and the second lateral channel is adapted to receive the second upper side panel.

Yet another aspect of the invention provides for an upper rear insulation pocket in the upper rear panel which is defined by the exterior wall of the upper rear panel (28E) and an interior surface (28F) with a width shorter than the width of the exterior wall. In another aspect, the upper rear insulation pocket has two vertical edge portions which define lateral channels in the upper rear panel.

In another aspect of the invention, the rear panel (22, 23) has two vertical edge portions (22A, 22B, 23A, 23B), a first lateral channel (22C, 23C) extending parallel to a first vertical edge portion (22A, 23A), and a second lateral channel (22D, 23D) extending parallel to a second vertical edge portion (22B, 23B) wherein the first lateral channel is adapted to receive the first side panel and the second lateral channel is adapted to receive the second side panel. In another aspect, the rear panel includes a rear insulation pocket defined by the exterior wall of the rear panel (22E, 23E) and an interior surface (22F, 23F) with a width shorter than the width of the exterior wall. In yet another aspect, the rear insulation pocket has two vertical edge portions which define the first and second lateral channels of the rear panel.

In another aspect of the invention, the rear panel comprises a substantially rectangular top portion (22) and a substantially rectangular bottom portion (23). In this aspect, the top portion has a height h, the bottom portion has a height substantially equal to h, and the first and second side panels have a height substantially equal to 2h.

Another aspect of the invention provides a first (40) and second (44) mounting members or brackets, wherein the first and second side panels are adapted to be mounted on the corresponding first and second mounting bracket. In another aspect, the first and second mounting brackets are substantially U-shaped.

In another aspect of the invention, the mounting members comprise a horizontal mounting portion (42, 46), a vertical mounting portion (41, 45) and a brace portion (43, 47) which is positioned between the horizontal mounting portion and the vertical mounting portion, and which supports the horizontal mounting portion.

In another aspect, the roof assembly (25) of the present invention comprises a pitched top portion (25A) and two vertical side portions (25B, 25C) wherein the roof assembly is configured and arranged to be positioned on top of the first and second side panels. In another aspect of the invention, the roof assembly is secured to the first and second side panels with screws (e.g. 25D, 25E).

Several aspects of the invention provide that adjoining or connected members and panels are secured together with screws (e.g. 48A, 48B, 48C).

In another aspect of the invention, a top panel (26) is provided which may be positioned on top of the first and second side panels, and beneath the roof assembly. In another aspect of the invention, the top panel includes a top insulation pocket defined by a top surface (26A) and an interior surface (26B). In this and many aspects of the invention, the top, rear, bottom and side insulation pockets comprise insulation such as Styrofoam insulation.

In another aspect of the invention, the top, bottom, side and rear panels, and the roof assembly, comprise galvanized steel.

In another aspect of the invention, the first and second side panels include side insulation pockets defined by the corresponding exterior walls (20A, 21A) and interior surfaces (20B, 21B) of the respective side panels.

In another aspect of the invention, the bottom panel includes a bottom insulation pocket defined by the bottom surface (24B) and the interior surface (24A) of the bottom panel. In another aspect of the invention, the first and second side panels are adapted to snap into, or interlock with, the lateral channels in the rear panel.

In another aspect of the invention, each of the top, bottom, rear and side panels, and the roof assembly, are substantially rectangular.

Another aspect of the invention provides a method of assembling a prefabricated fireplace enclosure adapted for compact packaging and connection to an exterior supporting wall of a structure. In that aspect, a first side panel and a second side panel, a first mounting member securable to the supporting wall, a second mounting member securable to said supporting wall, a rear panel and a bottom panel adapted for positioning between the first side panel and said second side panel, and a roof assembly adapted for support by said first side panel and said second side panel, are provided. The mounting members are secured to the supporting wall. The first side panel is secured to the first mounting member, and the second side panel is secured to the second mounting member. In addition, the rear and bottom panels are secured between the first side panel and said second side panel, and the roof assembly is positioned on top of the first and second side panels, whereby the fireplace enclosure is assembled and forms a part of the exterior of the structure to which it is connected.

In another aspect, first and second upper side panels, first and second upper mounting members securable to said supporting wall, and an upper rear panel adapted for positioning between said first upper side panel and said second upper side panel, are provided. The first and second upper mounting members are secured to the supporting wall above the first and second mounting members, respectively. The first and second side panels are secured to the first and second upper mounting members, and the upper rear panel is positioned between the first and second upper side panels, whereby the height of the fireplace enclosure may be adjusted.

The general object of the invention is to reduce the cost of and time associated with fireplace construction and installation.

Another object of the invention is to provide a fireplace enclosure adapted for compact packaging. Another object is to provide a prefabricated fireplace enclosure which is easy and inexpensive to ship, and which may be shipped in knock-down or disassembled condition. Yet another object is to provide a prefabricated fireplace enclosure which is easy to install.

Another object is to provide a prefabricated fireplace enclosure which requires no additional insulation, Sheetrock or support.

Another object is to provide an essentially modular fireplace enclosure with a variable height to accommodate various types of fireplaces and venting methods.

Yet another object is to provide a fireplace enclosure which permits efficient access to and installation of gas and electric lines.

These and other objects and advantages will become apparent from the foregoing and ongoing written specification, the accompanying drawings and the appended claims.

DESCRIPTION OF THE PREFERRED EMBODIMENTS

Figure 1:
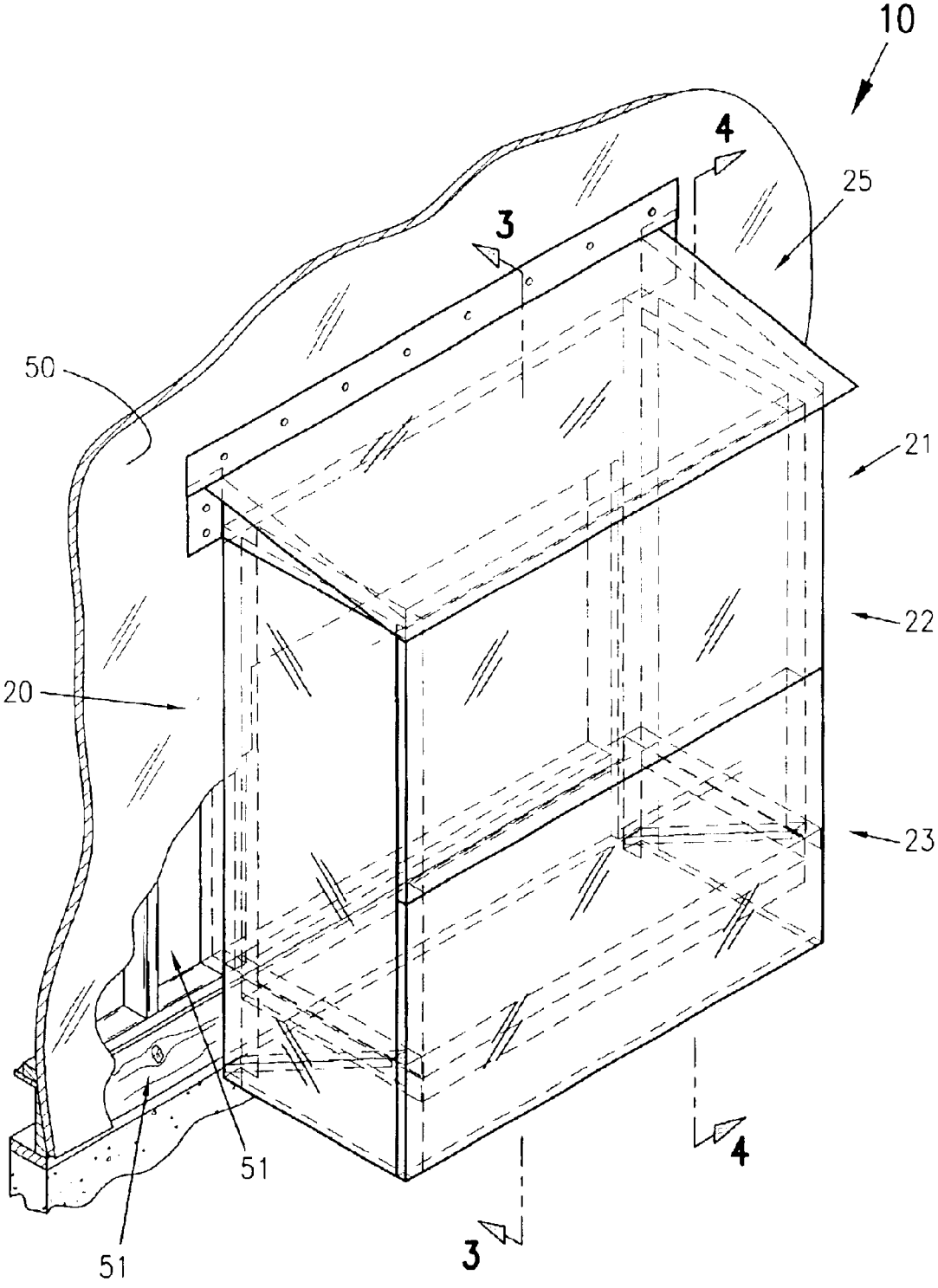
FIG. 1 is a perspective view of the fireplace enclosure of the present invention.

At the outset, it should be clearly understood that like reference numerals are intended to identify the same structural elements, parts, portions or surfaces consistently throughout the several drawing figures, as such elements, parts, portions or surfaces may be further described or explained by the entire written specifications, of which this detailed description is an integral part. Unless otherwise indicated, the drawings are intended to be read together with the specification, and are to be considered a portion of the entire written description of this invention. As used in the following description, the terms "horizontal", "vertical", "left", "right", "up" and "down", as well as adjectival and adverbial derivatives thereof (e.g., "horizontally", "rightwardly", "upwardly", "radially", etc.), simply refer to the orientation of the illustrated structure as the particular drawing figure faces the reader. Similarly, the terms "inwardly," "outwardly" and "radially" generally refer to the orientation of a surface relative to its axis of elongation, or axis of rotation, as appropriate.

Referring now to the drawings, FIG. 1 illustrates a preferred embodiment of the invention in perspective view. This embodiment of the fireplace enclosure 10 is attached to the exterior or supporting wall 50 of a home or building and the corresponding framing 51 of the home or building. The embodiment includes a first side panel 20 and a second side panel 21, a substantially rectangular top portion of the rear panel 22 and a substantially rectangular bottom portion of the rear panel 23, and a roof assembly 25.

Figure 2:
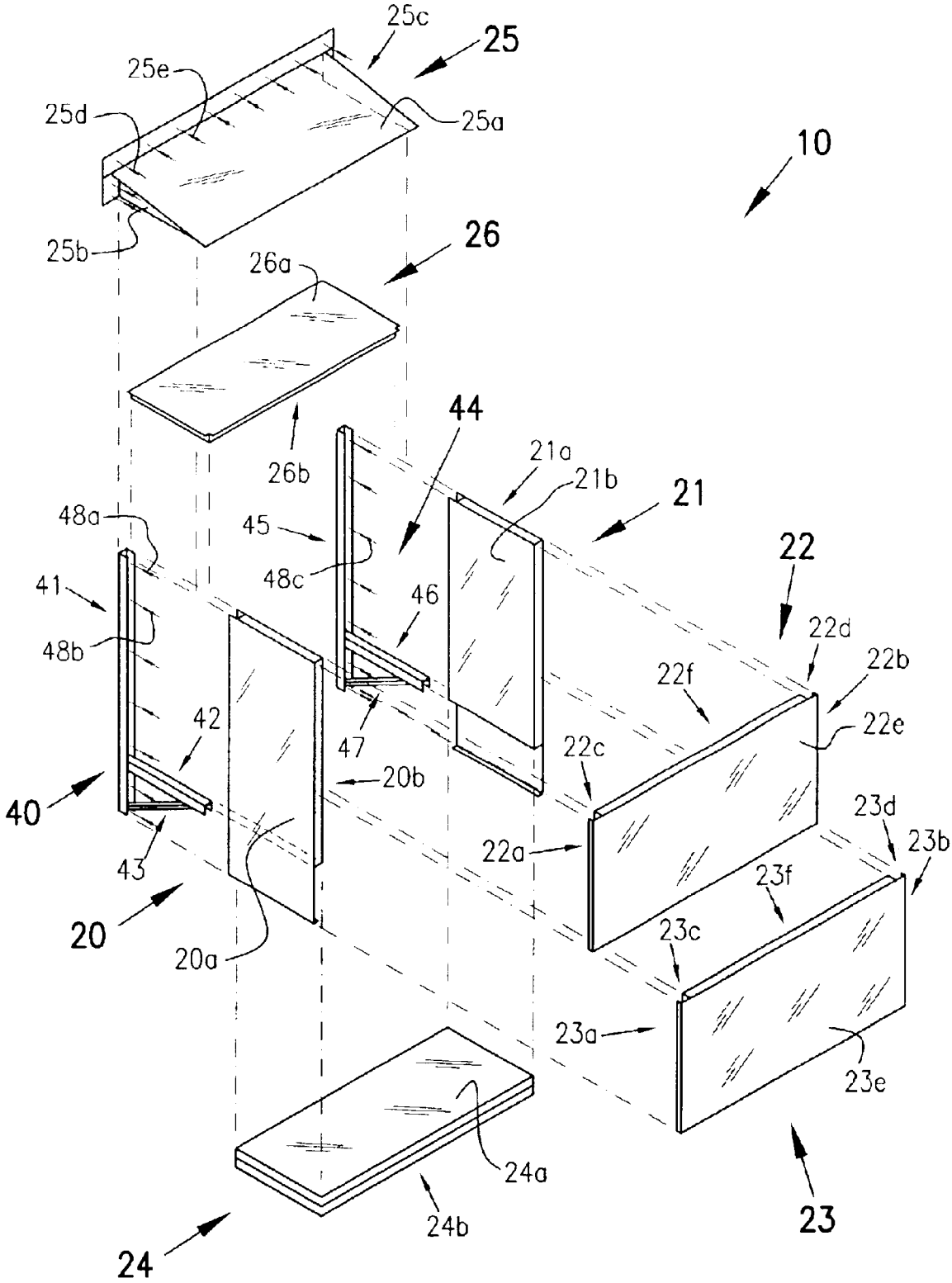
FIG. 2 is an exploded view of the fireplace enclosure of the present invention.

FIG. 2 provides additional detail not depicted in FIG. 1. In particular, the embodiment includes a first mounting member 40 and a second mounting member 44, both securable to the exterior or supporting wall 50 for supporting the first side panel 20 and second side panel 21, respectively. The first mounting member includes a vertical, U-shaped portion 41 securable to the exterior wall of the home with screws 48A, 48B, and a horizontal, U-shaped portion 42 supported by a brace 43 for supporting the first side panel 20. Similarly, the second mounting member includes a vertical portion 45, a horizontal portion 46 supported by a brace 47, for supporting the second side panel 21.

In this embodiment, the first side panel includes an insulation pocket defined by the exterior wall of the panel 20A and the interior surface of the panel 20B. Similarly, the second side panel includes an insulation pocket defined by its exterior wall 21A and interior surface 21B. The top portion of the rear panel 22 is defined by two vertical edges 22A, 22B, an exterior wall 22E and an interior surface 22F, which define first and second vertical channels 22C, 22D. Similarly, the bottom portion of the rear panel 23 is defined by two vertical edges 23A, 23B, an exterior wall 23E and an interior surface 23F, which define first and second vertical channels 23C, 23D. In this embodiment, the top and bottom portions of the rear panel are secured to the first and second side panels 20, 21 with screws. In addition, the bottom panel, which is secured to the first and second side panels with screws, includes an insulation pocket defined by the interior surface 24A and a bottom surface 24B.

The roof assembly 25 includes a top pitched portion 25A and two vertical side portions 25B, 25C. The roof assembly 25 is securable to the exterior surface of the home or building 51 with screws 25D, 25E, and rests upon the side panels 20, 21 and top portion of the rear panel 22, to which it is secured with screws.

In addition, this embodiment includes a top panel 26 having an insulation pocket defined by a top surface 26A and a bottom surface 26B. The top panel is also secured to the first side panel 20 and second side panel 21 with screws.

The U-shaped channels on the side of the first side panel and second side panel which face the mounting brackets 40, 44 are configured such that the respective channels fit over or snap on the corresponding U-shaped horizontal portion 41, 45 of the corresponding mounting bracket or member. The channels in the rear panels 22C, 22D, 23C, 23D snap on or fit over the corresponding sides of the first side panel 20 and second side panel 21, and may be mounted or attached with screws.

Figure 3:
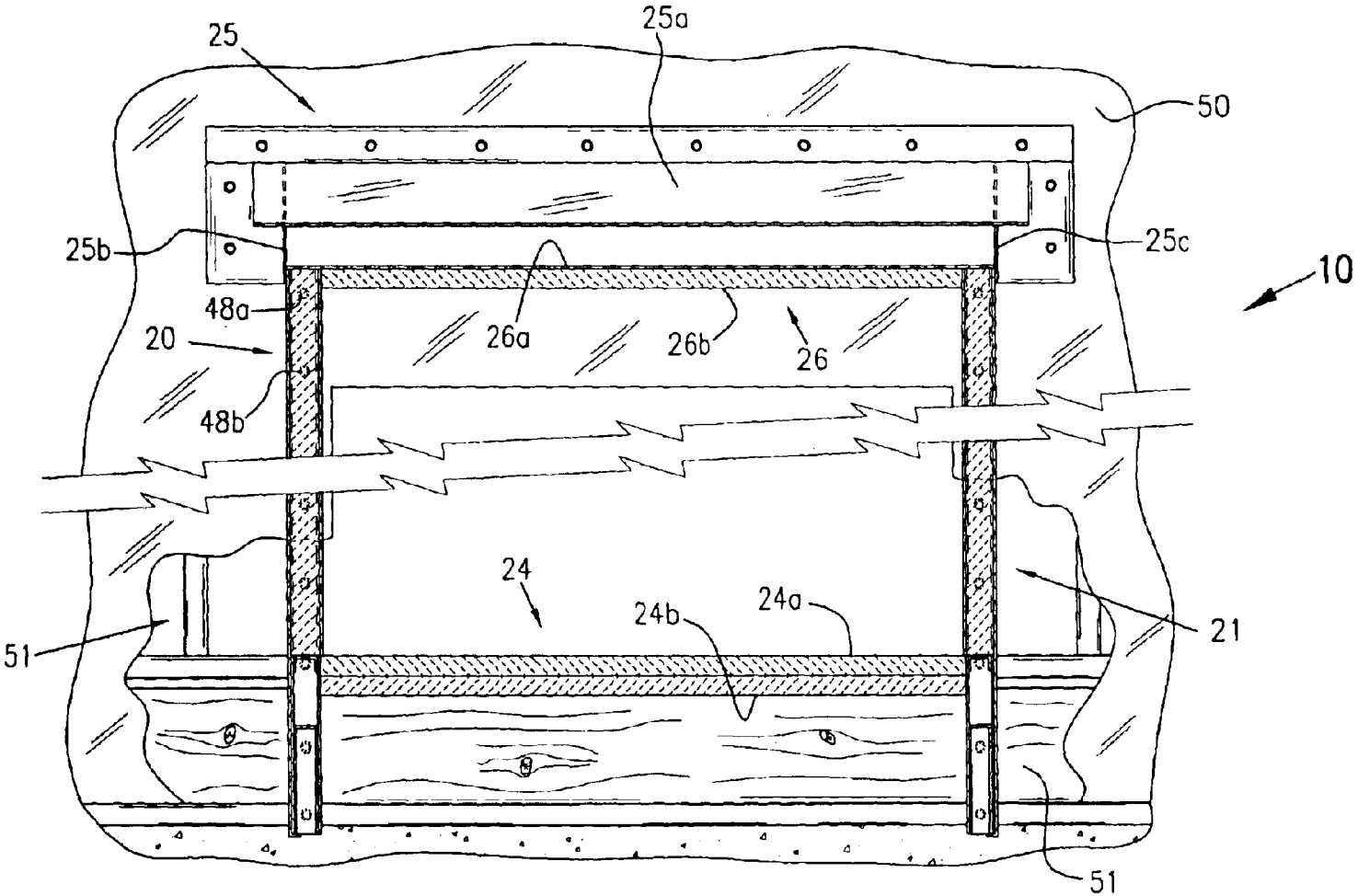
FIG. 3 is a front view of the fireplace enclosure of the present invention.

FIG. 3 is a front view of this embodiment which depicts the attachment of the fireplace enclosure to the exterior or supporting wall 50 of the home or building and the framing 51 with a number of screws, e.g. 48A, 48B.

Figure 4:
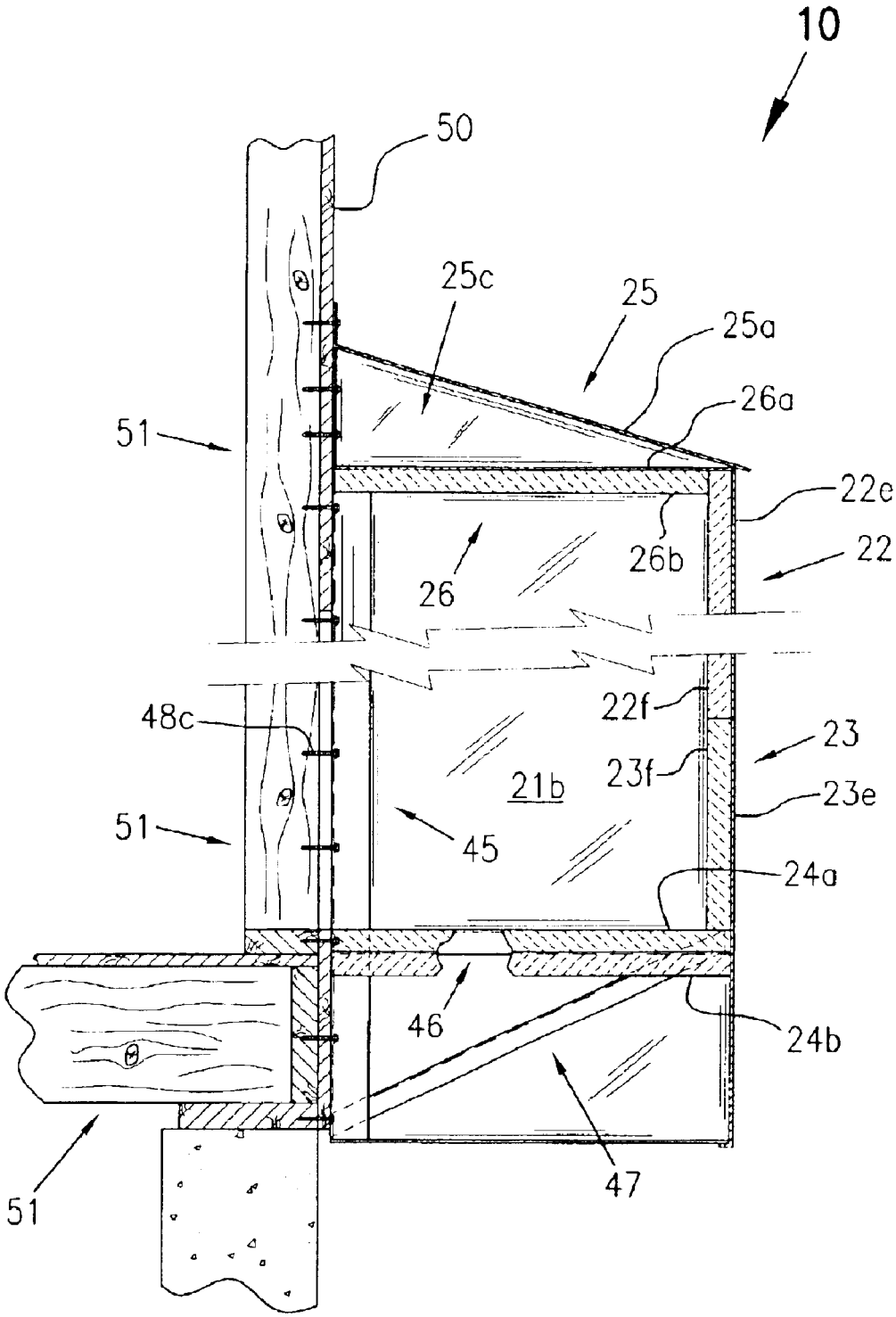
FIG. 4 is a side view of the fireplace enclosure of the present invention.

FIG. 4 is a side view of the fireplace enclosure in this embodiment which shows the attachment of the fireplace enclosure to the exterior or supporting wall 50 of the home or building and framing 51 with a number of screws.

Figure 5:
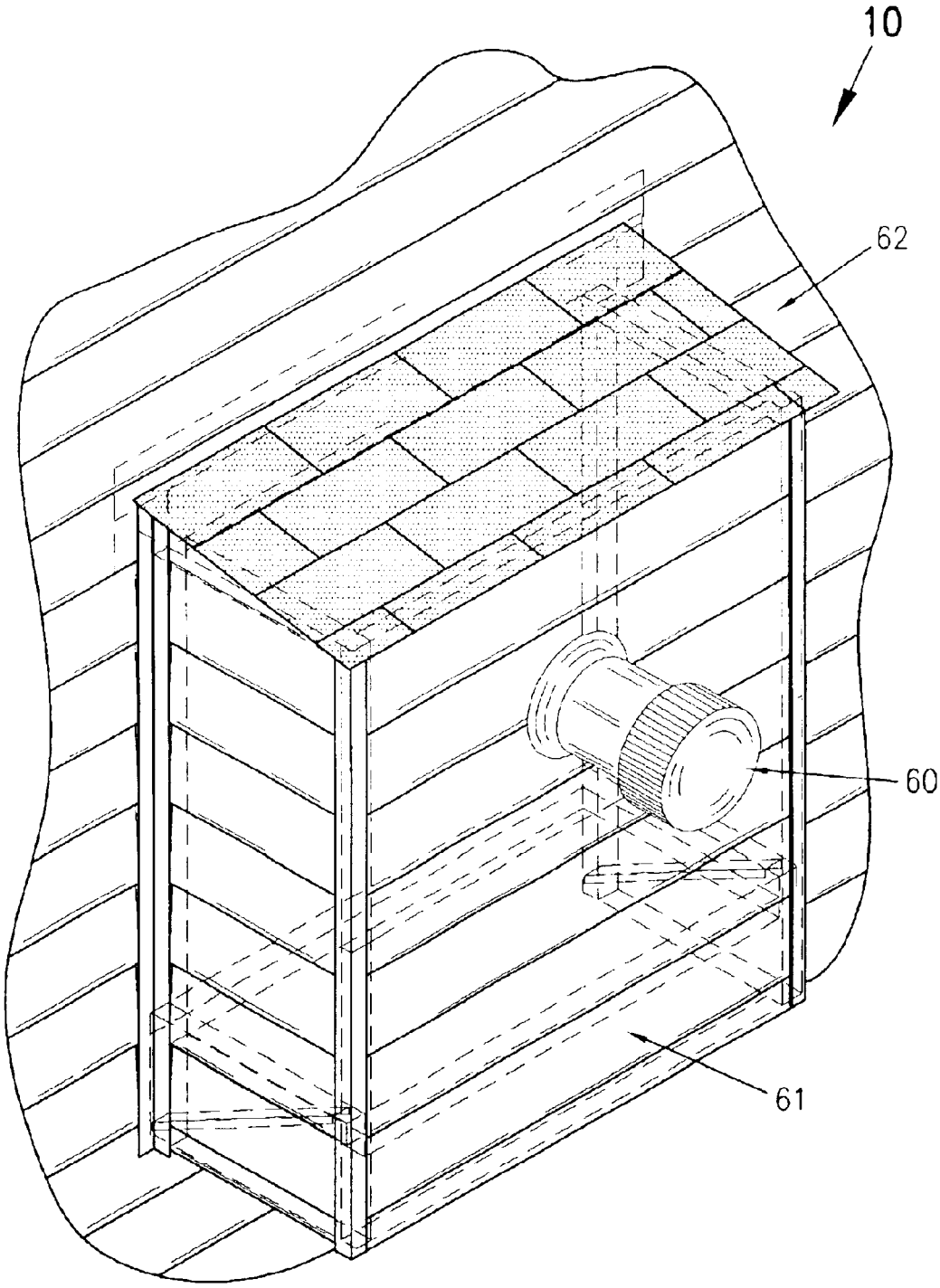
FIG. 5 is a perspective view of the fireplace enclosure of the present invention depicted with attached siding, roofing and vent cap.

FIG. 5 is an illustration of the fireplace enclosure which includes siding 61, a vent cap 60 and roofing 62 which may be added to the fireplace enclosure after installation of the fireplace enclosure.

Figure 6:
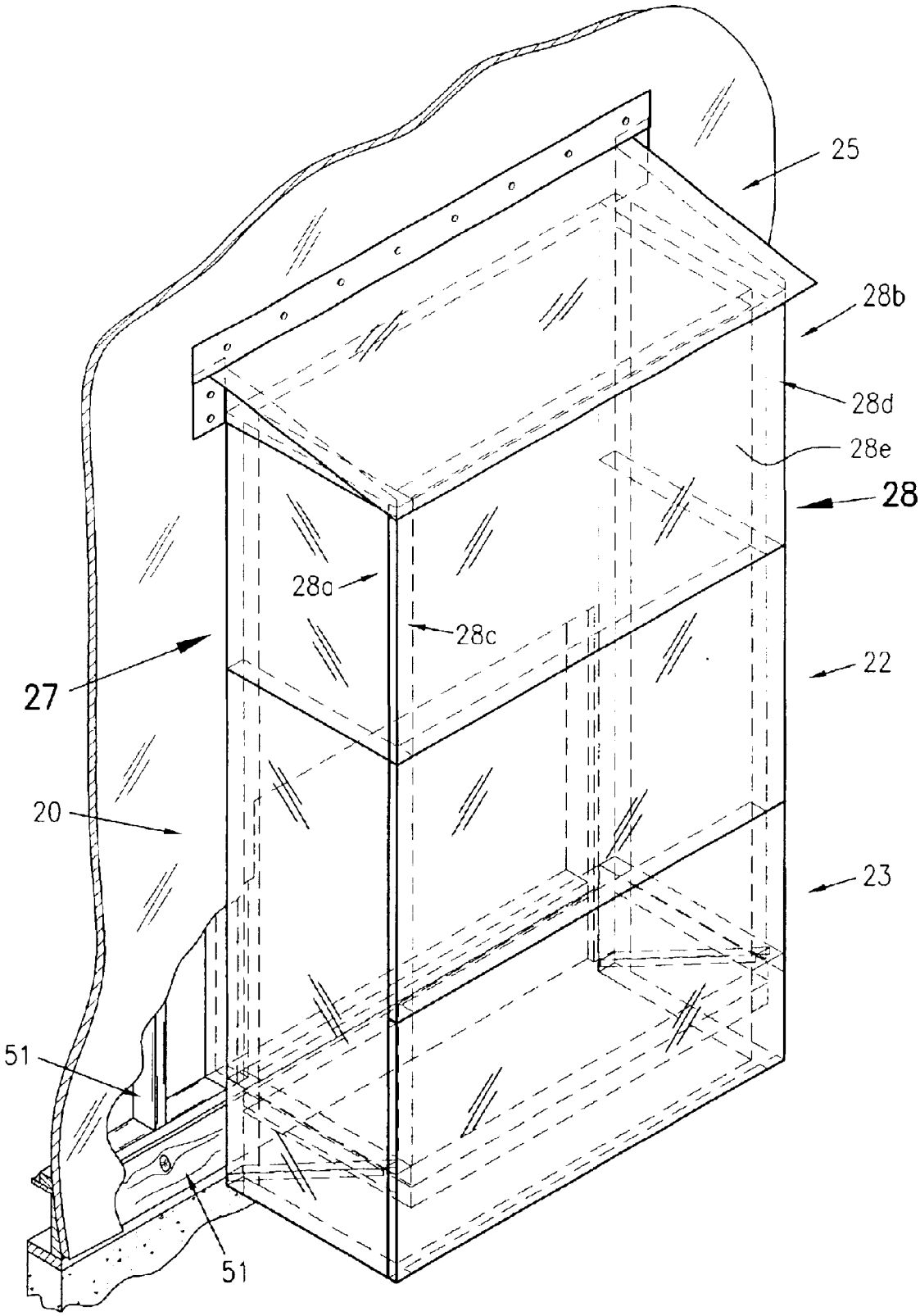
FIG. 6 is a perspective view of the fireplace enclosure of the present invention depicted with upper side and rear panels.
Figure 7:
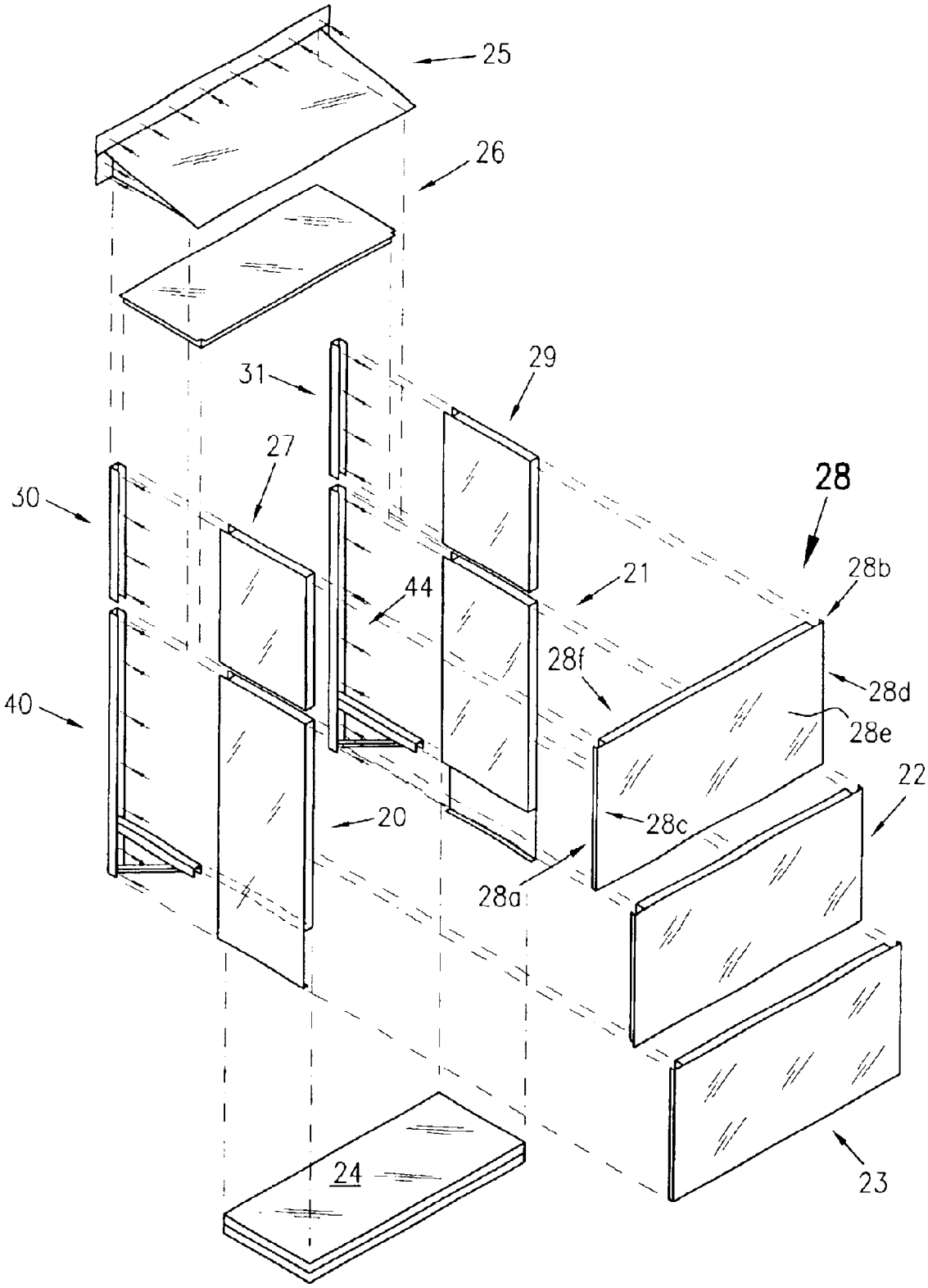
FIG. 7 is an exploded view of the fireplace enclosure of the present invention depicted with upper side and rear panels.

FIG. 6 is an illustration of another embodiment of the invention which includes first and second top side panels 27, 29 and a top rear panel 28 which are stacked upon the corresponding first and second side panels 20, 21 and rear panel 22. As shown in FIG. 7, an exploded view of FIG. 6, this embodiment includes upper mounting members 30, 31 which are U-shaped and stacked upon the corresponding lower mounting members 40, 44. The upper rear panel 28 includes two vertical edge portions 28A, 28B, an exterior wall or surface 28E and an interior surface 28F, which define vertical channels 28C, 28D, which vertical channels snap on or fit around the corresponding upper side panels 27, 29. The upper rear panel may be secured or affixed or attached to the corresponding upper side panels with screws. The described surfaces of the upper rear panel define an insulation pocket which may include Styrofoam insulation, which each of the previously described insulation pockets may include. In addition, the upper side panels 27, 29 include insulation pockets defined in the same manner as the insulation pockets in the first side panel and second side panel.

Modifications

The present invention contemplates that many changes and modifications may be made. For example, other means may be used to secure the side panels to the mounting members, and to secure the mounting members to the supporting wall. The various panels and mounting members may also be manufactured from composite materials or plastics, for example.

Therefore, while the presently-preferred form of the improved fireplace enclosure has been shown and described, and several modifications and changes thereof discussed, persons skilled in this art will readily appreciate the various additional changes and modifications that may be made without departing from the spirit of the invention, as defined and differentiated by the following claims.

What is claimed is:

1. A prefabricated fireplace enclosure adapted for compact packaging and adapted for connection to an exterior supporting wall of a structure, comprising:

a first side panel and a second side panel;

a first mounting member, securable to a supporting wall, for supporting said first side panel, and a second mounting member, securable to said supporting wall, for supporting said second side panel;

rear panel and a bottom adapted for positioning between said first side panel and said second side panel;

a roof assembly adapted for support by said first side panel and said second side panel;

a first upper side panel and a second upper side panel;

a first upper mounting member, securable to said supporting wall, for supporting said first upper side panel, and a second upper mounting member, securable to said supporting wall, for supporting said second upper side panel;

an upper rear panel adapted for positioning between said first upper side panel and said second upper side panel;

wherein said first upper side panel, said second upper side panel, and said upper rear panel are configured so as to be vertically stacked upon a corresponding first side panel, second side panel, and rear panel;

each of said panels, said mounting members and said roof assembly being configured so as to allow for compact packaging and shipment in a disassembled condition;

wherein said fireplace enclosure forms a part of the exterior of the structure to which it is connected.

2. The fireplace enclosure of claim 1 wherein said upper rear panel comprises two vertical edge portions, a first lateral channel extending parallel to a first vertical edge portion, and a second lateral channel extending parallel to a second vertical edge portion;

said first lateral channel being adapted to receive said first upper side panel, and said second lateral channel being adapted to receive said second upper side panel.

3. The fireplace enclosure of claim 2 wherein said upper rear panel comprises an exterior wall and an interior surface having a width shorter than said exterior wall, wherein said interior surface and said exterior wall define an upper rear insulation pocket.

4. The fireplace enclosure of claim 3 wherein said upper rear insulation pocket comprises a first vertical edge portion defining said first lateral channel, and a second vertical edge portion defining said second lateral channel.

5. A prefabricated fireplace enclosure adapted the compact packaging and adapted for connection to an exterior supporting wall of a structure, comprising;

a first side panel and a second side panel;

a first mounting member, securable to a supporting wall, for supporting said first side panel, and a second mounting member, securable to said supporting wall, for supporting said second side panel;

a rear panel and a bottom panel adapted for positioning between said first side panel and said second side panel;

a roof assembly adapted for support by said first side panel and said second side panel;

wherein said rear panel comprises two vertical edge portions, a first lateral channel extending parallel to a first vertical edge portion, and a second lateral channel extending parallel to a second vertical edge portion;

said first lateral channel being adapted to receive said first side panel and said second lateral channel being adapted to receive said second side panel;

each said panels, said mounting members and said roof assembly being configured so as to allow for compact packaging and shipment in disassembled condition;

wherein said fireplace enclosure forms a part of the exterior of the structure to which it is connected.

6. The fireplace enclosure of claim 5 wherein said rear panel comprises an exterior wall and an interior surface having width shorter than exterior wall, wherein said interior surface and said exterior wall define a rear insulation pocket.

7. The fireplace enclosure of claim 6 wherein said rear insulation pocket comprises a first vertical edge portion defining said first lateral channel, and a second vertical edge portion defining said second lateral channel.

8. The fireplace enclosure of claim 5 wherein said first side panel is adapted to snap into said first lateral channel of said rear panel, and said second side panel is adapted to snap into said second lateral channel of said rear panel.

9. A prefabricated fireplace enclosure adapted for compact packaging and adapted for connection to an exterior supporting wall of a structure, comprising;

a first side panel and a second side panel;

a first mounting member, securable to a supporting wall, for supporting said first side panel, and a second mounting member, securable to said supporting wall, for supporting said second side panel;

a rear panel and a bottom panel adapted for positioning between said first side panel and said second side panel;

a roof assembly adapted for support by said first side panel and said second side panel;

wherein said roof assembly comprises a pitched top portion and two vertical side portions, and wherein said roof assembly is configured and arranged to be positioned on top of said first side panel and said second side panel;

each of said panels, said mounting members and said roof assembly being configured so as to allow for compact packaging and shipment in a disassembled condition;

wherein said fireplace enclosure forms a part of the exterior of the structure to which it is connected.

10. A prefabricated fireplace enclosure adapted for compact packaging and adapted for connection to an exterior supporting wall of a structure, comprising;

a first side panel and a second side panel;

a first mounting member, securable to a said supporting wall, for supporting said first side panel, and a second mounting member, securable to said supporting wall, for supporting said second side panel;

a rear panel and a bottom panel adapted for positioning between said first side panel and second side panel;

a roof assembly adapted for support by said first side panel and said second side panel;

a top panel adapted to be positioned on top of said first side panel and said second side panel and beneath said roof assembly;

each of said panels, said mountinig members and said roof assembly being configured so as to allow for compact packaging and shipment in a disassembled condition;

wherein said fireplace enclosure forms a part of the exterior of the structure to which it is connected.

11. The fireplace enclosure of claim 10 wherein said top panel comprises a top surface and an interior surface, wherein said top surface and said interior surface define a top insulation pocket.

12. A method of assembling a prefabricated fireplace enclosure adapted for compact packaging and adapted for connection to an exterior supporting wall of a structure, comprising;

providing a first side panel and second side panel; a first mounting member for supporting said first side panel, and a second mounting member for supporting said second side panel; a rear panel and bottom panel adapted for positioning between said first side panel and said second side panel; a roof assembly adapted for support by said first side panel and said second side panel;

securing said first mounting member and said second mounting member to a supporting wall;

securing said first side panel to said first mounting member, and securing said second side panel to said second mounting member;

securing said rear panel and said bottom panel between said first side panel and said second side panel;

positioning said roof assembly on top of said first side panel and said second side panel;

providing a first upper side panel and a second upper side panel; a first upper mounting member for supporting said first upper side panel, and a second upper mounting member for supporting said second upper side panel; and upper rear panel adapted for position between said first upper side panel and said second upper side panel;

securing said first upper mounting member to said supporting wall above said first mounting member, and securing said second upper mounting member to said supporting wall above said second mounting member;

securing said first side panel to said first upper mounting member, and securing said second upper side panel to said second upper mounting member;

positioning said upper rear panel between said first upper side panel and said second upper side panel;

whereby said fireplace enclosure is assembled and forms a part of the exterior of the structure to which it is connected.

* * * * *